United States Patent [19]

Ousley

[11] 4,373,270

[45] Feb. 15, 1983

[54] SUNDIAL

[76] Inventor: Russell M. Ousley, 3640 Santiago Dr., Florissant, Mo. 63033

[21] Appl. No.: 269,909

[22] Filed: Jun. 3, 1981

[51] Int. Cl.[3] ..... G04B 49/00

[52] U.S. Cl. ..... 33/270

[58] Field of Search ..... 33/268, 269, 270, 271, 33/272, 275

[56] References Cited

U.S. PATENT DOCUMENTS

| | | | |
|---|---|---|---|
| 783,245 | 2/1905 | Clarke | 33/270 |
| 2,668,357 | 2/1954 | Whipple | 33/270 |
| 3,786,570 | 1/1974 | Davies | 33/270 |

FOREIGN PATENT DOCUMENTS

| | | | |
|---|---|---|---|
| 1445146 | 8/1976 | United Kingdom | 33/270 |

*Primary Examiner*—Harry N. Haroian

*Attorney, Agent, or Firm*—Rogers, Eilers & Howell

[57] ABSTRACT

A sundial comprising a block of transparent material in the general form of a frustrum of a semi-cylinder, with first planar surface at an angle to the cylindrical axis that corresponds as nearly as may be to the complement of the angle of latitude at which the device is to be used, a second diametrical surface that has a medial index or gnomon line coincident with the cylindrical axis, and with a plurality of concave flutes on the cylindrical surface extending parallel to the cylindrical axis and providing, between adjacent ones, narrow, flat, translucent, substantially linear surfaces fifteen degrees apart.

5 Claims, 5 Drawing Figures

SUN'S RAY
5
5
16
10
14
15
12
20
25

SUNDIAL

BACKGROUND OF THE INVENTION

Heretofore sundials made of clear cylinders have been known, as for example, in the U.S. patent to Putnam, U.S. Pat. No. 2,846,768, and somewhat similar sundials have been shown in U.S. patent to Carlson, U.S. Pat. No. 3,786,570, and traditional sundials with flat plates and angularly disposed gnomons have been known for centuries. Hemispherical sundials were made by Berosus before the Christian era, and continued in use as late as 900 A.D. See Vol. 7, Encyclopedia Britannica, 14th Ed. pp. 310–314.

The present invention comprises a single block of translucent, preferably transparent material graduated to indicate time from before 7:00 a.m. to after 5:00 p.m. It does this without any moving parts. It can be small enough to be used on a window sill, or any other place where it can be exposed to the sun. It can be made of clear plastic or glass so that it is not seriously injured by weathering. It also forms a convenient device for use in instructing students in the relationship of the sun and the earth.

IN THE DRAWINGS

Figures 1, 2, 3, 4, 5:
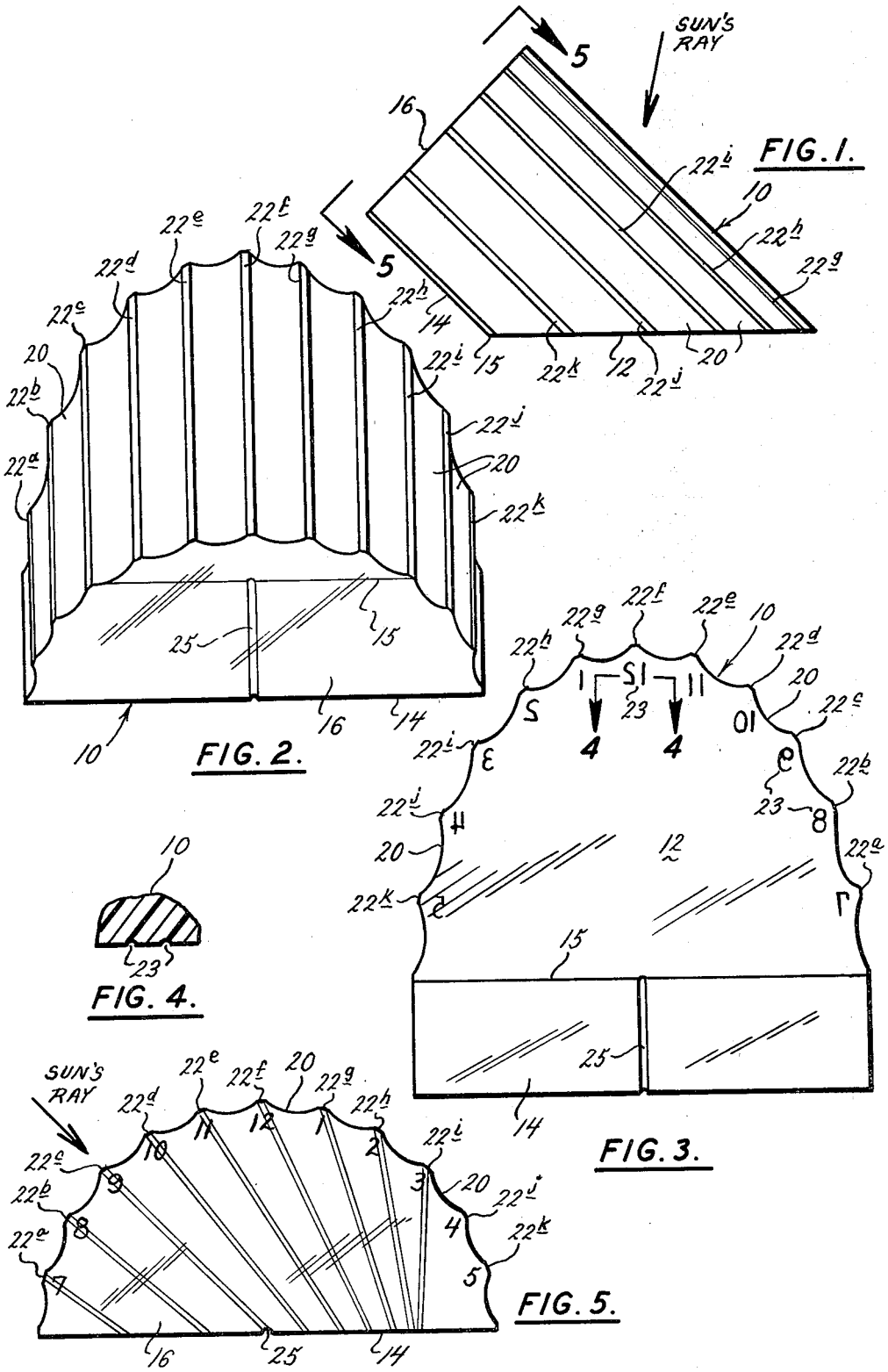
FIG. 1 is a side elevation of the device.
FIG. 2 is a top plan view of the device.
FIG. 3 is a bottom view.
FIG. 4 is a fragmentary section on the line 4—4 of FIG. 3.
FIG. 5 is a view taken on the line 5—5 of FIG. 1 looking toward the semi-circular surface.

The device comprises a body member, here in the form of a semi-cylindrical solid block 10 of transparent plastic or glass material. It has a bottom surface 12 that is planar and directed at an angle to the cylindrical axis that corresponds as nearly as is practical to the latitude of use of the sundial. There is a diametric surface 14 parallel to the cylindrical axis intersecting the surface 12 in a transverse edge 15. There is also a transverse semicircular surface 16 that is here shown as perpendicular to the surface 14.

The periphery of the block is divided into a plurality of sections by concave grooves 20 between which are a series of flat surfaces 22*a*–22*k*. The fluting between these flat strips is preferably somewhat roughened so as to be translucent but to diffuse light, whereas the surfaces 22*a*–22*k* are clear and transparent. The fluting thus comprises darkening means to let light in restrictedly in contrast to the effect of the flat surface strips 22*a*–22*k*. These flat strips are 15° apart, representing the hours of the day. Graduations 23 represent the different hours of time.

The diametric surface 14 has a groove 25 cut in it medially and along the cylindrical axis, from the edge 15 to the surface 16, to act as an index.

IN USE

The device is placed on a flat surface where it is exposed to the sun with the index 25 oriented north and south with the surface 16 disposed toward the north (in the northern hemisphere). The angle of the surface 12 to the cylindrical axis disposes the cylindrical axis in near parallelism to the earth's axis. The user then looks down toward the viewing surface 16. Sunlight that strikes all of the flat strip surfaces that are exposed to it, and is transmitted through the block, appearing as a plurality of luminous rays extending toward the edge 15. These lines move down angularly toward the intersection of the surfaces 14 and 12, tending to converge as they go toward it, owing to refraction. The beam whose lower end is nearest to the index 25 is tracked back to its surface 22*a*–22*k* at which point the time is read by the appropriate graduation 23 on the surface 16. The particular flat surface 22*a*–22*k* of its origin will be observed to be the one most nearly perpendicular to the sun's rays.

In FIG. 5, the light beam nearest the index 25 tracks back to the 9:00 o'clock time indication. To give another illustration, assume that the nearest beam to the index in a particular case is tracked back to between the indications "1" and "2". If it should be about two-thirds of the way from the "1" to the "2" line of rays, then it would indicate that the apparent time is approximately twenty minutes of two.

It is, of course, important to orient the index as nearly parallel to the earth's axis as may be. It must be in the north-to-south plane of the earth. It is also, as noted, desirable to have the fluted surfaces directly perpendicular to the incoming rays of the sun. Therefore, if the surfaces are cut at forty-five degrees, which would be satisfactory for the northern part of this country, and it is desired to have a more accurate time reading in a more southern part of the country, a wedge could be placed tilting the block to reduce that angle. For example, at lower Missouri, the angle should be approximately thirty-seven and one-half degrees. However, for most purposes, the angle need not be so critical.

There are various changes and modifications that may be made to applicant's invention as would be apparent to those skilled in the art. However, any of these changes or modifications are included in the teaching of applicant's disclosure and he intends that his invention be limited only by the scope of the claims appended hereto.

What is claimed is:

1. A sundial, comprising a translucent body member having a semi-cylindrical surface with a plurality of relatively clear, light-transmitting, spaced narrow flat surfaces thereon separated by relatively dark surfaces, the flat surfaces being spaced apart one from another around the semi-cylindrical surface by a predetermined distance representing a chosen time interval in travel of sunlight across the earth from east to west, a diametric surface on the member with an index marked thereon parallel to the cylindrical axis of the semi-cylindrical surface, the body member being adapted to be disposed in sunlight with its cylindrical axis at least approximately parallel to the earth's axis, so that the beam transmitted through the flat surface that ends nearest the index represents the apparent time.

2. In the sundial of claim 1, the body member being a solid block of material, and a bottom surface thereon extending at an angle to the cylindrical axis to dispose the block with its cylindrical axis approximately parallel to the earth's axis.

3. In the sundial of claim 2, the block having concave flutes on its cylindrical surface between the flat surfaces.

4. In the sundial of claim 3, the surfaces of the flutes being roughened to transmit reduced and diffused light.

5. In the sundial of claim 1, the flat surfaces being 15° apart around the semi-cylindrical surface, and the body member having calibrations thereon representing the time for each flat surface.

* * * * *